United States Patent [19]

Michalski

[11] 4,197,437

[45] Apr. 8, 1980

[54] SNAP-ACTION SWITCH

[75] Inventor: Dieter Michalski, Berlin, Fed. Rep. of Germany

[73] Assignee: ITT Industries, Inc., New York, N.Y.

[21] Appl. No.: 671,138

[22] Filed: Mar. 29, 1976

[30] Foreign Application Priority Data

Apr. 8, 1975 [DE] Fed. Rep. of Germany ..... 2515185

[51] Int. Cl.² ..... H01H 21/04

[52] U.S. Cl. ..... 200/67 D; 200/159 A; 200/283

[58] Field of Search ..... 200/17 D, 67 DA, 159 R, 200/159 A, 159 B, 5 A, 275, 290; 74/100 R, 100 P

[56] References Cited

U.S. PATENT DOCUMENTS

| | | | |
|---|---|---|---|
| 2,266,537 | 12/1941 | Elmer | 200/67 DA |
| 3,941,953 | 3/1976 | Mission et al. | 200/5 A |
| 4,032,728 | 6/1977 | Oelsch | 200/67 DB |
| 4,046,982 | 9/1977 | Schadow et al. | 200/5 A |

*Primary Examiner*—Harold J. Tudor

*Attorney, Agent, or Firm*—James B. Raden; William J. Michals

[57] ABSTRACT

A snap-action switch for use with electric circuits is disclosed, having a roof-shaped elastic sheetmetal member intended to cooperate with several contacts of a printed circuit. By depressing the roof along a folding edge, the sheetmetal member is caused to snap along a line extending transversely in relation to the folding edge, thus first opening one contact and thereafter closing another contact.

1 Claim, 16 Drawing Figures

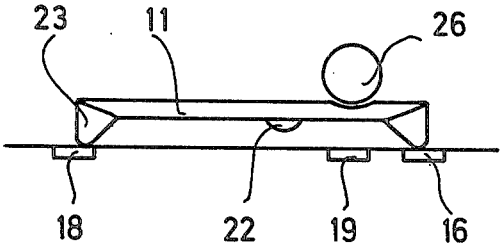
Fig. 3
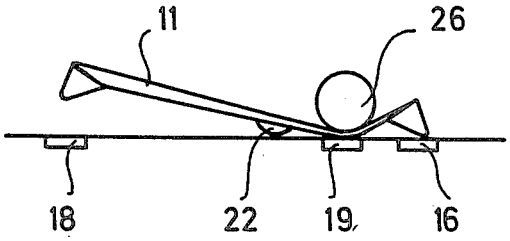
Fig. 4
Fig. 6
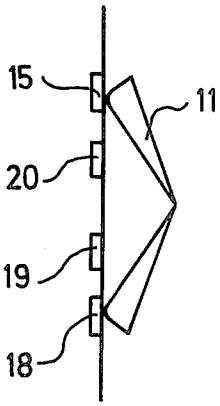
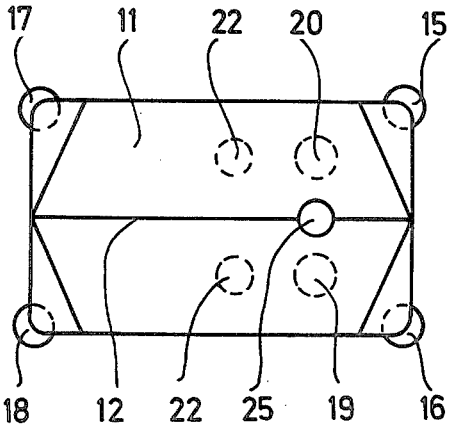
Fig. 5

Fig. 7
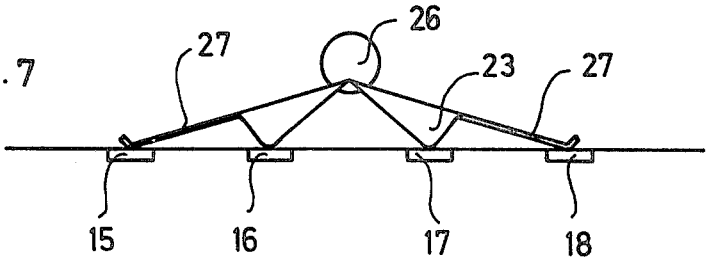
Fig. 8
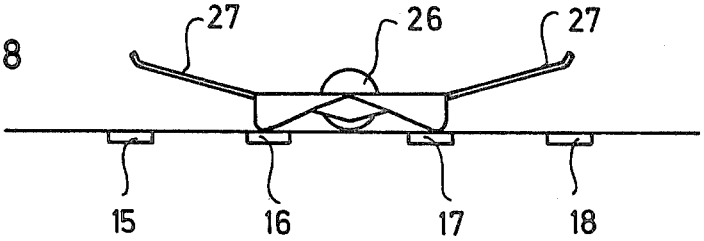
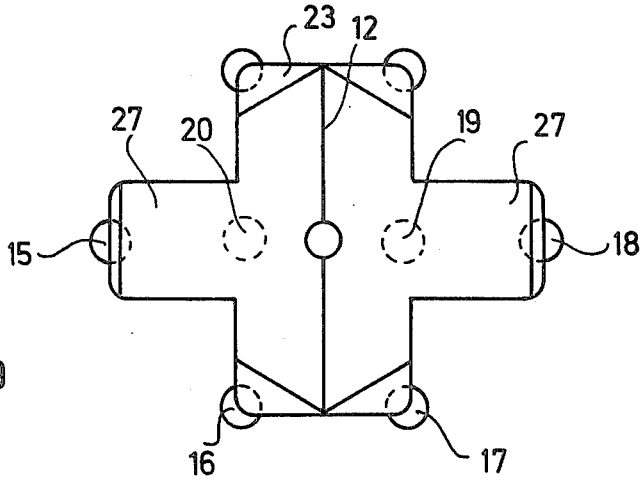
Fig. 9

SNAP-ACTION SWITCH

BACKGROUND OF THE INVENTION

1. Field of the Invention

The present invention relates to an electrical snap-action switch. It is formed by an arched elastic sheet-metal member which, when subjected to compressive stress by an actuating element, is capable of rapidly snapping from a stable position into a metastable position, thus effecting the closing and/or opening of contacts.

2. Description of the Prior Art

Electrical snap-action switches operating on the arched elastic sheetmetal member principle, providing snap actions in response to changes in pressure exerted upon the arch are known.

As an example, the German Pat. No. 458,899 discloses an electrical snap-action switch using a snapping spring element consisting of at least two flat springs which are joined at the ends. In this case the spring element is designed in such a way that the one flat spring is shorter than the other one. Because of the difference in lengths, when the flat springs are joined to one another at their ends, at least one is arched and they can be caused to snap-over by actuating them at the ends where they are joined to one another. Such snapping elements consisting of several different long flat springs joined to one another, however, are not easy to manufacture, and a snap-action switch employing such spring elements has a rather complicated construction.

Moreover, from the German Published Patent Application (DOS) No. 21 02 218 there is known an electrical switch comprising a snapping spring element, in which the spring element has a frame-like construction and projections are arranged in the recess of the frame, to be bent out of the plane of the spring by means of a suitable actuating element. By bending out this projection there is achieved a snapping of the frame parts towards the one or the other side, which is utilized for actuating switching contacts. Also in this case the spring element has a complicated construction and requires expensive actuating devices.

Furthermore, these conventional types of snap-action switches still have the disadvantage of having to be reactuated subsequently to the snapping over, to enable them to return to their original switch position.

Finally, from the German Published Patent Application (DOS) No. 23 06 268 there is known a switch employing a snapping spring element having the shape of a round arched plate spring. In this type of switch the spring element, subsequent to being snapped-over, assumes a metastable position so as to snap back into the original position as soon as the pressure ceases to be exerted by the actuating element. The plate shaped spring element, in this case, rests on an angular (ring shaped) contact which must be so high as to permit the spring to be pushed through beyond its plane position. The contacts to be actuated are arranged on circular lines concentrically in relation to the supporting ring of the spring. In this conventional type of switch, of course, the spring element is of a very simple design, but the contact travel paths are very short, so that only very low voltages can be switched apart from any danger resulting from a short-circuit in the event of soiling, or contamination, of the contacts.

SUMMARY OF THE INVENTION

It is therefore an object of the invention to provide an electrical snap-action switch comprising an elastic arched sheet metal member as the setting element, which avoids the disadvantages of the conventional types of switches.

In particular, the invention is aimed at providing snap-action switches with longer contact travel paths, with the switch merely consisting of a small number of parts of simple construction. Moreover, the switch is also intended to be capable of performing switching functions, especially for use with non-shorting change-over switches, i.e., upon actuation there is first opened the one contact and only thereafter a second contact is closed. The fixed contacts of the switch including their lead-in conductors are ordinarily arranged on one side of a printed circuit board.

With respect to an electrical snap-action switch of the type mentioned hereinbefore, the above-mentioned objects are achieved in that the arched elastic sheet metal member is bent off or arched along at least one line, by resting with its rim portions on a plane surface, and capable of being bent (buckled) by the action of the actuating element along another line.

In the known conventional types of snap-action switches, the arched resilient element has been pushed through by the actuating element completely towards the other side, in order to achieve the snapping effect. From this principle the present invention deviates in that the bending of the elastic sheet metal member is not effected along the arching, but along another line.

In one preferred embodiment of the invention, the bending line is arranged to extend almost vertically in relation to the folding line of the sheet metal member.

This principle enables the achievement of a particularly simple electrical snap-action switch in which the contact travel paths are considerably enlarged as compared to those of conventional types of snap-action switches employing arched sheet metal members.

The bending line along which the sheet metal member is bent during the snapping process, may be established in different ways. One way is to arrange an abutment at a suitable point on the plane support on which the sheet metal member is supported, and to let the actuating pressure act against the abutment in such a way that the sheet metal member will be bent over substantially in parallel with the abutment. The abutment, however, may also be formed as part of the sheet metal member itself, in that the sheet metal member, at suitable points, is provided with bosses or projections lying on the plane support which, just like an abutment arranged on the support, effect a defined bending. The bosses serving as the support during the bending of the sheet metal member, simultaneously serve as reinforcements within the surface area of the sheet metal member. The bending line, however, may also be defined by weak points provided for in the sheet metal member. Such weak points, for example, may be represented by holes or recesses at the edges of the sheet metal member.

A further advantageous embodiment is disclosed in which the sheet metal member is not only arched or bent along one line, but along two intersecting lines, such as along two diagonals.

DESCRIPTION OF THE DRAWINGS

Further embodiments and advantages of the invention will now be explained in greater detail with reference to some preferred examples of embodiments shown in FIGS. 1 to 16 of the accompanying drawings, in which:

FIGS. 3 to 6 illustrate aspects of another exemplary embodiment of the invention both in side and top views, FIGS. 7 to 9 show a modification of an embodiment of the invention both in a side and top view.

DESCRIPTION OF PREFERRED EMBODIMENTS

Figure 1:
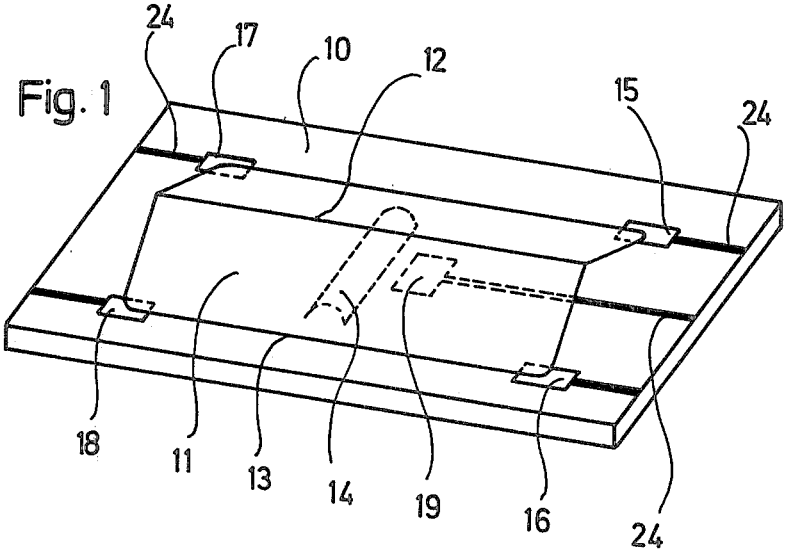
FIGS. 1 and 2 schematically show a preferred example of an embodiment of the invention in perspective.
Figure 2:
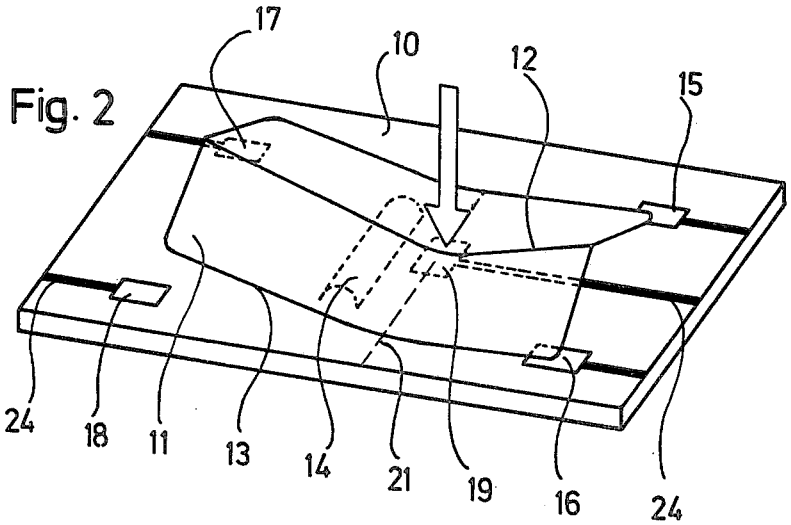

FIGS. 1 and 2, in a perspective representation, show the underlying principle of a switch on which the invention is based. The elastic sheet metal member 11 is positioned on a plane support 10 which may be a printed circuit board. The sheet metal member is roof-shaped, i.e., angled off along the folding line 12. The angled-off sheet metal member rests with its convex side, and by means of the edge portions 13, on the support 10. On this support (base) below the sheet metal member, there is arranged a suitable abutment 14 which is arranged almost vertically in relation to the folding line 12. Preferably with a defined pre-tension (bias), the corners of the sheet metal member 11 rest on contact surfaces 15, 16, 17 and 18 which are connected to circuit arrangement via the lead-in conductors 24. The pre-tension may be produced either directly or indirectly by the actuating element. In the center below the sheet metal member, on one side of the abutment 14, there is arranged a further contact 19 which is likewise provided with a lead-in conductor 24. The contacts 15, 16, 17 and 18 are all bridged by the sheet metal member. For ensuring an improved contact-making, the parts of the sheet metal member which are in touch with the fixed contacts, may be provided with a coating of conductive material.

In order to actuate the switch, as is denoted by the arrow in FIG. 2, pressure is exerted upon the sheet metal member along the folding line 12 opposite the contact 19. Owing to the abutment 14, the sheet metal member, as is shown in FIG. 2, snaps over somewhat along the bending line 21 so as to come in touch with the contact 19 by being lifted off the contacts 17 and 18. The contacts at 15 and 16 remain closed, so that during the switching operation, the contact 19 is connected to the contacts 15 and 16 while the connection between the contacts 15 and 16 on one hand and 17 and 18 on the other hand, is interrupted. As may be seen from FIG. 2, the position of both the abutment 14 and the pressure point may be selected so that contact travel will be relatively large. In the course of this, first the connections with the contacts 17 and 18 are opened, and only thereafter the connection with the contact 19 is established. This is of importance in many electronic devices.

As may be seen from FIGS. 1 and 2, the essential parts of the switch according to the invention are of very simple construction. In the type of embodiment shown in FIGS. 1 and 2, the elastic sheet metal member is of rectangular design and roof-shaped. The invention, however, is in no way restricted to this rectangular design and the roof shape. Instead of a sharp bend 12, the sheet metal member may also be arched more or less, as long as the arching extends along one line.

FIGS. 3 to 6 show anther embodiment of the invention. FIGS. 3 and 4 are side views of the elastic sheet metal member as arranged on the support, in both the actuated and the non-actuated state. FIG. 5 is a top view of the arrangement shown in FIG. 3, and FIG. 6 is a side view of the arrangement shown in FIG. 5.

In order to achieve a good contact between the sheet metal member and the fixed contact as arranged on the support, the sheet metal member, also in its normal position, is lightly pressed against the contacts, and the corners of the sheet metal member 11 are angled off as indicated at point 23 in FIG. 3. In this way, it is possible to make a flexible contact, independently of the remaining reinforcements of the sheet metal member. Considering that the corners rest elastically on the fixed contacts, a slight lateral movement of the corners on the fixed contact is achieved upon actuation, this advantageously adding to the self-cleaning effect of the contacts. Instead of being provided with an abutment, the sheet metal member 11 comprises in this case two almost hemispherical bosses 22 which, upon actuation, will be pressed against the support and, together with the actuating point, serve to define the bending line. As an actuating device, there is shown to be used a ball 26 which is preferably supported in a hole 25 having a diameter smaller than that of the ball. As may be taken from FIG. 5, the sheet metal member is of almost rectangular shape and bent along the line 12. For achieving resilient contacts, the corners are bent downwardly at 23. Below the sheet metal member, two fixed contacts 19 and 20 are provided for coming in touch with the sheet metal member when the latter is being bent off.

A further embodiment of the invention is shown in FIGS. 7, 8 and 9 of the drawings. Here, the sheet metal member is provided with additional contact reeds capable of closing and opening further contacts. In FIGS. 7 and 8 the arrangement is schematically shown in a side view, with FIG. 7 representing the arrangement in the non-actuated state, and FIG. 8 showing the arrangement in the actuated state. FIG. 9 is a top view of the arrangement according to FIG. 7. As may be seen from FIG. 9, one contact reed 27 is shaped (attached) on each side of the almost rectangular sheet metal member having a folding line 12 and angled-off corners 23, with said contact reeds 27 each likewise having a bent-off edge portion.

Figure 10:
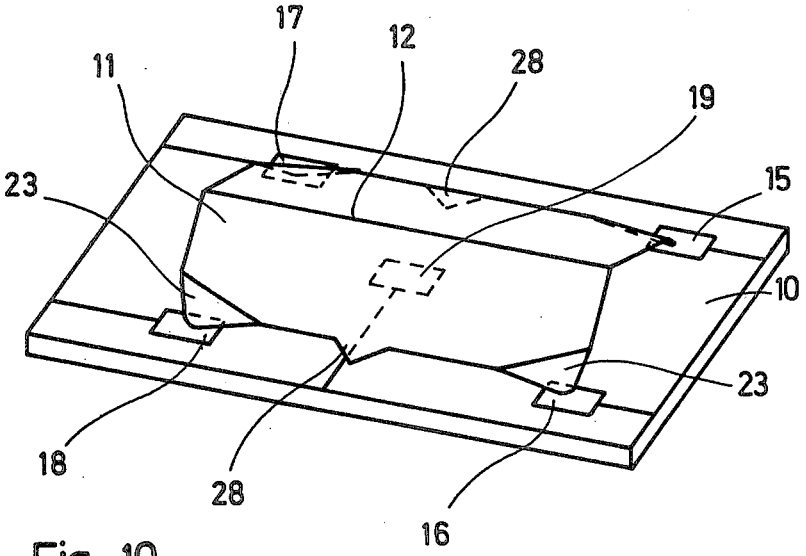
FIGS. 10 and 11 show a further example of an embodiment of the invention in a perspective view, FIGS. 12 and 13 in a perspective representation, show another embodiment of the invention in which the sheet metal member is shown to have two bending lines.
Figure 11:
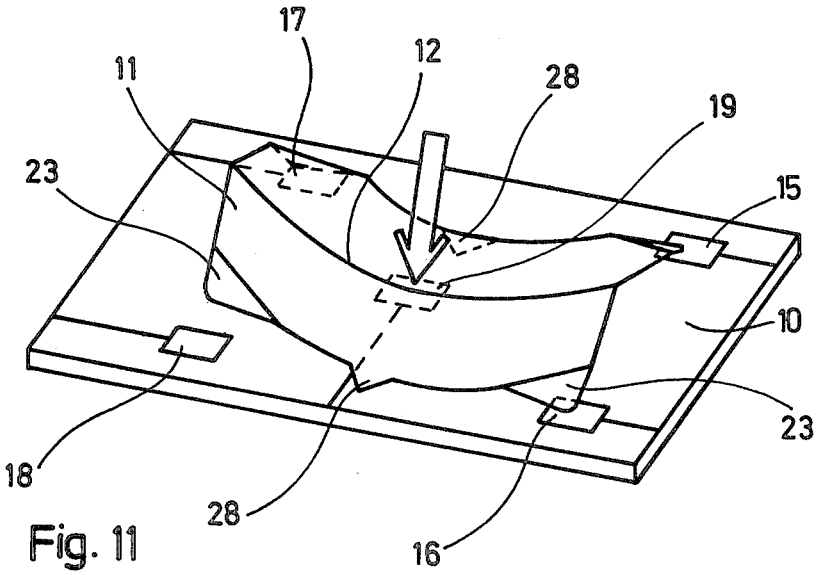

As an abutment determinative of the bending line, it is also possible to use projections provided for on the sheet metal member. On such arrangement is shown in a perspective representation in FIGS. 10 and 11. On the plane support 10, comprising the fixed contacts 15, 16, 17, 18 and 19, there is shown a roof-shaped sheet metal member 11 having a folding edge 12. To enable a better contact to be made, the corners are bent off at 23. At the two points 28, the sheet metal member comprises two projections which lie on the support as an abutment during actuation. FIG. 10 shows the arrangement in the non-actuated state, while FIG. 11 shows the state of the arrangement after it has been actuated. The actuating member, opposite the fixed contact 19, presses upon the sheet metal member within the area of the folding line 12, as is indicated by the arrow. In this way, the contacts at 17 and 18 are opened, and the contact at 19 is closed.

Figure 12:
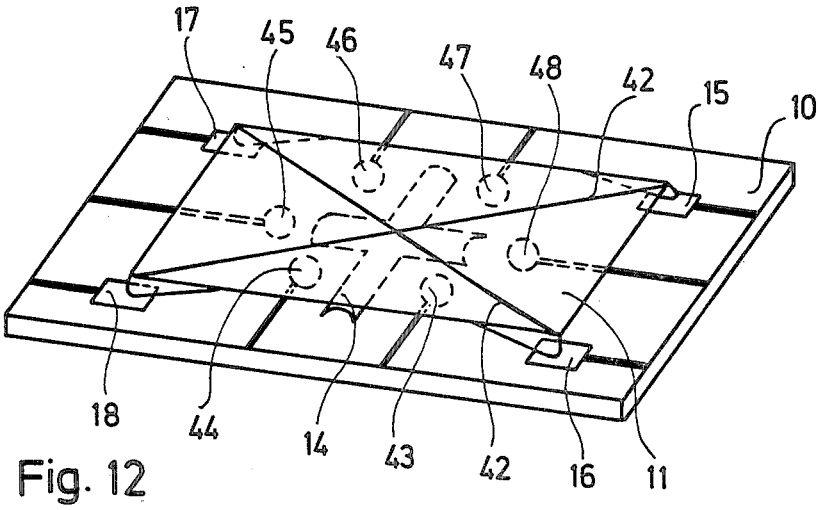
Figure 13:
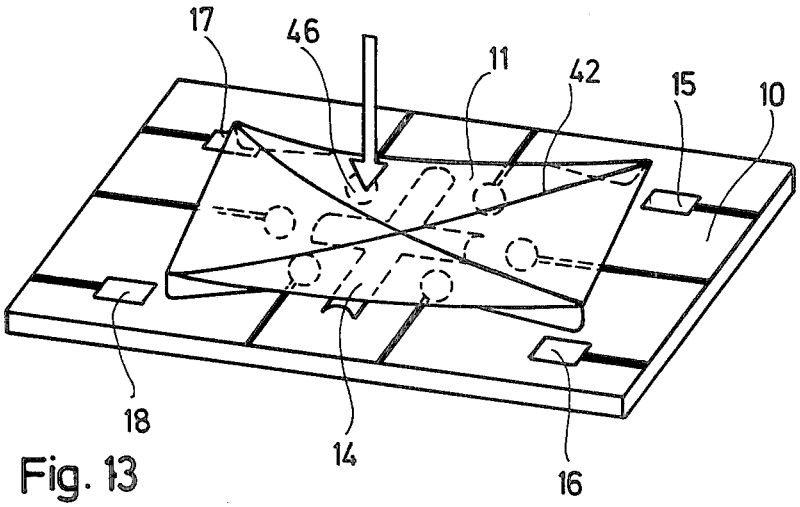

It is not absolutely necessary for the sheet metal member to be bent off only along one single folding line but, in fact, it is also possible to use sheet metal members which are bent along several lines as is shown in a perspective representation in FIGS. 12 and 13. In this case, two folding lines 42 are provided as diagonals of the sheet metal member. The abutment 14 is of cross-shaped design, and the fixed contacts 43, 44, 45, 46, 47 and 48 are provided below the sheet metal member. Pressure may be exerted by an actuating element upon the sheet metal member opposite one of the aforementioned fixed contacts. It is also possible to provide several such actuating elements so that by optionally operating various ones of the actuating elements, it is possible to perform different switching functions.

Figure 14:
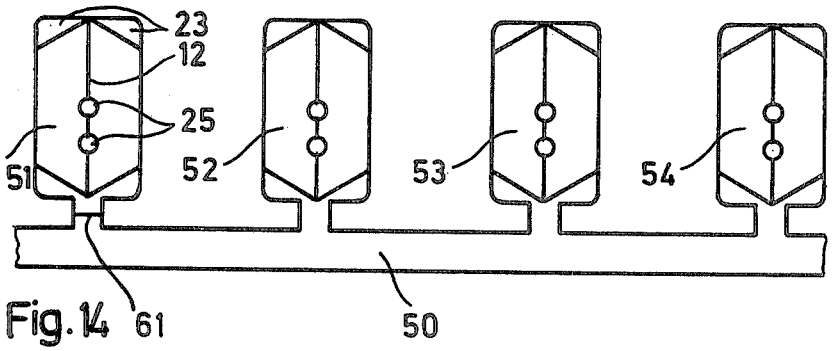
FIG. 14 shows an arrangement of several sheet metal members joined to one another.

Whenever larger numbers of switches according to the invention are to be arranged in one row, the sheet metal members for the individual switches may be punched out of a larger sheet metal plate in such a way that they hang together via one common strip. One such arrangement is shown in FIG. 14. The strip 50, holding the individual sheet metal members together, may be used as a lead-in conductor common to all switches.

As has been described hereinbefore with reference to the drawings, a considerable upward movement of one part of the sheet metal member is effected in response to an actuation of the sheet metal member, thus causing certain ones of the contacts on the underlying circuit board to be opened. This upward movement of the sheet metal member in response to actuation, may also be used for closing further switching contacts in cases where a further printed circuit board with fixed contacts is arranged above the sheet metal member. In such cases, this circuit board will have to be provided with an opening for the actuating element. In this way, it is still possible to further increase the number of possible switching functions.

It is not absolutely necessary for the switching contacts to be actuated manually via an actuating element, but in fact, this may also be carried out either directly or indirectly by the armature of an electromagnet.

Figure 15:
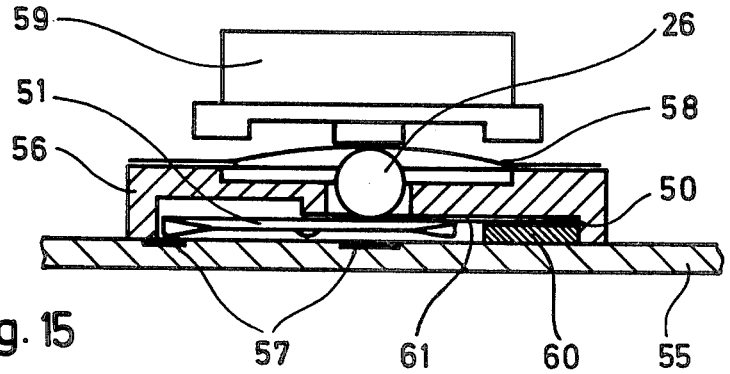
FIGS. 15 and 16 show cross sectional views taken through a switch according to the invention.
Figure 16:
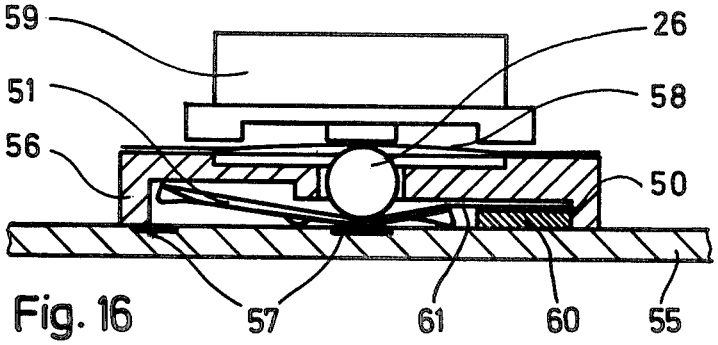

Sectional views of a switch according to the invention are shown schematically in FIGS. 15 and 16, with FIG. 15 showing the switch in the non-actuated state, and FIG. 16 showing the switch in its actuated state. This switch substantially comprises a flat housing member 56 including a cavity in which the elastic sheet metal member 51 is arranged. Moreover, the housing 56 includes an opening for guiding the actuating element 26. In cases where the elastic sheet metal member 51 is provided with a projection, or where several sheet metal members according to FIG. 14 are joined to one another by means of a common sheet metal strip, the latter may be clamped into a slot of the housing so as to retain the sheet metal member in the housing. The slot may also be formed by the housing and an additional strip 60 of insulating material. Preferably, a bent portion 61 (FIG. 14) is provided between the sheet metal strip 50 as clamped in the slot, and the elastic sheet metal member 51, in order thus to press the elastic sheet metal member with a defined pre-tension (bias) with its corners on to the contacts as arranged on the printed circuit board. On its bottom side, the housing is enclosed by a printed circuit board 55 on which fixed contacts 57 are mounted. The actuating element 26, as shown, may be in the shape of a ball, but may also be designed to have the shape of a pin. Appropriately, the housing is provided with an airtight seal effected by a foil or membrane on its topside. On the housing there may be arranged an actuating button 59 intended to move the actuating element through the foil or membrane 58.

In order to simplify the construction and reduce the number of parts, the actuating element 26 may be attached directly to the foil or membrane 58.

While the principles of the invention have been described above in connection with specific apparatus and applications, it is to be understood that this description is made only by way of example and not as a limitation on the scope of the invention.

What is claimed is:

1. An electrical snap-action switch in which an elastic member is resiliently deflectable from a stable to a metastable position to alternately open and close at least one pair of associated electrical contacts, said switch comprising:

a housing having a generally planar conductor-carrying insulator portion therein;

an actuating element to which an external operating force can be applied, said element being operatively mounted to said housing;

an arched elastic sheet metal member mounted in said housing between said element and said insulator portion, said member having a folded line along which it is arched and said folded line being located between edge portions of said member which engage a plane surface of said insulator portion, and said member having a bending line which extends transversely in relationship to the folding line, along which it is resiliently bent when it snaps between said stable and metastable positions, and means for determining said bending line located between said elastic member and said planar conductor—carry insulator portion whereby a portion of said member alternately engages and disengages a conductor carried by said insulator portion of said housing.

* * * * *